US005405090A

United States Patent [19]

Greene et al.

[11] Patent Number: 5,405,090

[45] Date of Patent: Apr. 11, 1995

[54] ELECTROSTATIC SPRAY GUN

[75] Inventors: Robert H. Greene, Leeds; Alan C. Outhwaite, Wakefield, both of United Kingdom

[73] Assignee: The Morgan Crucible Company PLC, England

[21] Appl. No.: 94,008

[22] PCT Filed: Jan. 28, 1992

[86] PCT No.: PCT/GB92/00156

§ 371 Date: Oct. 27, 1993

§ 102(e) Date: Oct. 27, 1993

[87] PCT Pub. No.: WO92/12798

PCT Pub. Date: Aug. 6, 1992

[30] Foreign Application Priority Data

Jan. 28, 1991 [GB] United Kingdom ..... 9101812

[51] Int. Cl.[6] ..... B05B 5/00

[52] U.S. Cl. ..... 239/708; 118/627; 118/629; 118/300; 239/323; 239/583; 239/690

[58] Field of Search ..... 118/629, 627, 300; 239/690, 708, 328, 579, 583, 584, 323

[56] References Cited

U.S. PATENT DOCUMENTS

| | | | |
|---|---|---|---|
| 3,056,557 | 10/1962 | Walberg | 18/629 |
| 3,323,682 | 6/1967 | Creighton, Jr. et al. | 222/94 |
| 3,409,225 | 11/1968 | Maddalozzo et al. | 239/584 |
| 4,066,041 | 1/1978 | Buschor et al. | 118/629 |
| 4,136,802 | 1/1979 | Mascia et al. | 222/95 |
| 4,557,803 | 3/1986 | Owen | 239/690 |
| 4,993,645 | 2/1991 | Buschor | 118/629 |

FOREIGN PATENT DOCUMENTS

| | | | |
|---|---|---|---|
| 0123164 | 10/1984 | European Pat. Off. . | |
| 2018627 | 10/1979 | United Kingdom . | |
| 2030060 | 4/1980 | United Kingdom . | |
| 1569707 | 6/1980 | United Kingdom . | |
| 2172219 | 9/1986 | United Kingdom | 239/690 |

*Primary Examiner*—Karen M. Hastings
*Assistant Examiner*—Laura E. Edwards
*Attorney, Agent, or Firm*—Larson and Taylor

[57] ABSTRACT

An electrostatic spray gun comprising a housing (32) for receiving a replaceable collapsible container, a nozzle (39) from which fluid is to be sprayed, squeeze grip mechanism (36, 35, 34) for compressing the container to feed fluid to the nozzle and high voltage contacts (**38*a*, 38*b*) for applying electrostatic potential to the fluid such that the fluid issues from the nozzle in the form of an electrically charged atomized spray, wherein the nozzle (39) forms or is fed by a resealable delivery valve having inner (11) and outer valve members (12**) with fluid fed to a gap between them by the compression of the container, from which gap the fluid emerges to form the spray and the gap being closable, desirably with a wipping, fluid-cleaning action, by relative movement of the members.

7 Claims, 8 Drawing Sheets

FIG. 2
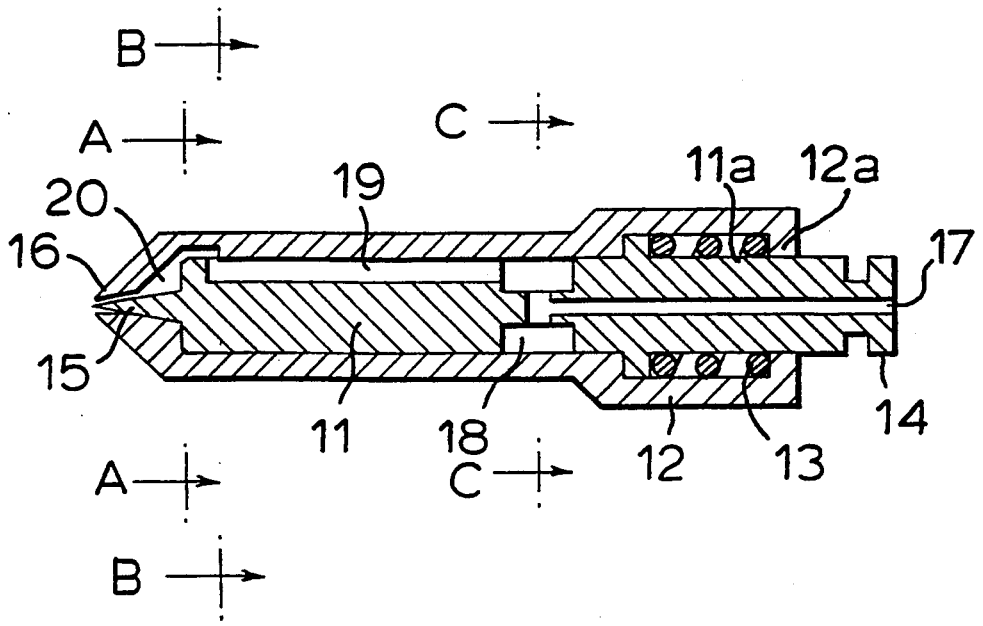
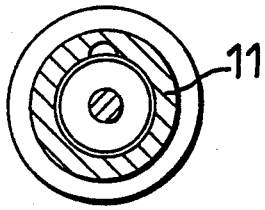
FIG. 2a
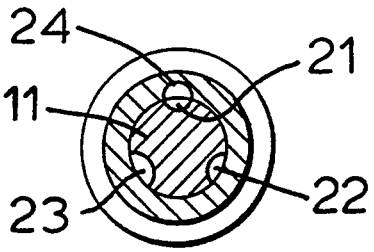
FIG. 2b
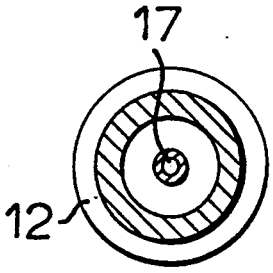
FIG. 2c

ELECTROSTATIC SPRAY GUN

FIELD OF INVENTION

The invention relates to an electrostatic spray gun.

BACKGROUND OF THE INVENTION

Electrostatic spray heads are described in U.K. patent specifications Nos. 1 569 707, 2 018 601, 2 030 060 and others, and complete spray units in for example their EPA 0 118 202. Fluid supplied to the head is broken up essentially by the action of a high voltage field to form charged droplets, which are then attracted to and deposit on an earthed target such as a plant crop. The current passing, which is minute and harmless, is supplied for example by dry cells. No impellant gas or mechanical action is involved in transport of the spray.

With the growing concern over discharge of volatiles into the environment, we have sought to develop a gun using replaceable containers and allowing control of a fluid to be sprayed, at low flow rates and low pressures, such as in particular to be a replacement for the widely used aerosol sprays.

SUMMARY OF THE INVENTION

Most broadly the invention provides an electrostatic spray gun comprising a housing for receiving a replaceable collapsible container, a nozzle from which fluid is to be sprayed, means for compressing the container to feed fluid to the nozzle and high voltage means for applying electrostatic potential to the fluid such that the fluid issues from the nozzle in the form of an electrically charged atomised spray, wherein the nozzle forms or is fed by a resealable delivery valve having inner and outer valve members with fluid fed to a gap between them by the compression of the container, from which gap the fluid emerges to form the spray and the gap being closable, desirably with a wiping, fluid-cleaning action, by relative movement of the members.

The collapsible container can be of any suitable form including a simple sachet but will in any event have at least a part of its fluid containing portion flexible walled. Similarly the delivery valve/nozzle may be in any convenient form, separate or combined, whereby if the nozzle is regarded as the part of the gun in which the spray is formed and delivered the valve can constitute the nozzle or simply feed fluid to it.

The valves allow particularly advantageous forms of construction, wherein fluid flow at the low pressures afforded by hand operation and low flow rates of for example up to 20 ml/min that are envisaged, is nevertheless well controlled. Conveniently the gap between the valve members constitutes or is fed by a fluid path of flow-limiting form, suitably an elongate channel of flow-limiting cross section formed between or in one of the valve members. Conveniently further there may then be alternative channels of differing cross sections selectable by the user, or a single channel with different lengths selectable to control passage of the fluid.

Subsidiary concepts applicable to the above or independently in guns broadly as above, that is to say guns comprising a housing for receiving a container, a nozzle from which the fluid is to be sprayed, means for compressing the container to feed fluid to the nozzle and high voltage means for applying electrostatic potential to the fluid such that the fluid issues from the nozzle in the form of an electrically charged atomised spray, are:

a) The use, in or with a given gun, of containers of different sizes and thus capacities; for example their use within a given space in the gun by means of different container and spacer combinations or their use in a disposable nose section of a gun, such nose section comprising the container and optionally the valve/nozzle also.

b) Particularly in this last context but also in the guns generally when larger volumes of fluid are required, the use of containers that are of concertina form, especially concertina sachets. Such sachets can be regarded as having successive sachet elements joined centrally with an open area for the container contents to pass from one element to the next. Progressive deformation is very conveniently afforded by such a construction with smooth controlled collapse under axial force and ready maintenance of constant delivery. The sachets may be within a rigid external sleeve and other forms of flexible container so confined are an alternative to them, feeding to a valve at one end and emptied by pressure from the other. A container emptied by eversion of a flexible plastics wall within such a sleeve under pressure of a piston is particularly suitable, the flexible wall effectively affording a rolling diaphragm seal between sleeve and piston.

c) The use, especially with containers of different capacities, of compressive means giving step by step compression under the control of a trigger (also desirably actuating the electrostatic generator) for example by controlled release of the pressure of a spring or advance of such compression means as a ratchet or the like.

In its detailed construction the gun may be designed so that the pressure required to collapse the container, and hence expel the contents, is either applied directly from the operation of a trigger or via a secondary means, whereby the trigger releases a secondary force.

Direct pressure on a trigger or handgrip may be transmitted to apply pressure to the collapsible container in a controlled manner. Coupled to this action, the H.T. generator is also operated. In the case of larger containers the travel of the trigger may be such that a regulator, e.g. a ratchet, is employed which on release of the trigger, moves the container and the point of pressure relatively to each other.

Secondary pressure may be applied to the collapsible container via a source independent of but controllably released by the trigger. This force can be applied for example by a spring mechanism located within the gun which acts as a drive force for a compressive plate which in turn compresses the collapsible container.

The gun can further be designed to accommodate a variety of sizes of collapsible containers for example by a variable sized chamber into which the collapsible container is inserted, the chamber being adjusted to fit the selected container size, or by an interchangeable housing designed around several sizes of container which are attached to the gun, or by designing a unit that contains a collapsible package such that the unit itself once attached to the gun becomes an integral part of the gun.

The valve mechanism is desirably so designed as to allow ease of filling of the contents and to act as a seal to prevent escape of product or ingress of contaminants during storage. Preferred is a blind inner-nozzle/movable outer cap system, with a space between them fed in use with the contents of the container, which emerge around the blind nozzle on relative movement of nozzle and cap. Such constructions where the container contents pass through an aperture in the side of the blind nozzle within the outer cap, readily provide for suitable flow restriction for example by the blind nozzle forming a tapered restrictor located within the nozzle of the spray tip. When closed the restrictor prevents blockages of the nozzle by travelling into the opening of the nozzle and forming an effective seal, thus preventing dripping and ingress of contaminants into the system.

Suitable containers are discussed above but generally include any container that when pressure is applied collapses, allowing the contents to be expelled in a controlled manner via the valve, which is conveniently attached to the container.

One example of such a collapsible container is a sachet particularly the concertina sachet referred to earlier, which collapses when subjected to axial pressure. Another example is a flexible bag or tube contained within an open-ended rigid support which when pressure is applied via the open end collapses in a controlled manner and particularly at a constant rate.

In both of the above cases the flexible container only collapses once the contents are allowed to be expelled by the operation of the valve system, and the design of the valve system and container is desirably such that when the pressure is released no further contents will be expelled or air allowed to ingress back into the container.

BRIEF DESCRIPTION OF THE DRAWINGS

Various guns according to the invention are illustrated by way of example in the accompanying drawings in which:

FIG. 2 shows a delivery valve with alternative fluid paths of different cross section, FIGS. 2*a* to 2*c* showing the valve in cross sectional view at A—A, B—B and C—C respectively in FIG. 2;

DETAILED DESCRIPTION OF THE INVENTION

Figure 1:
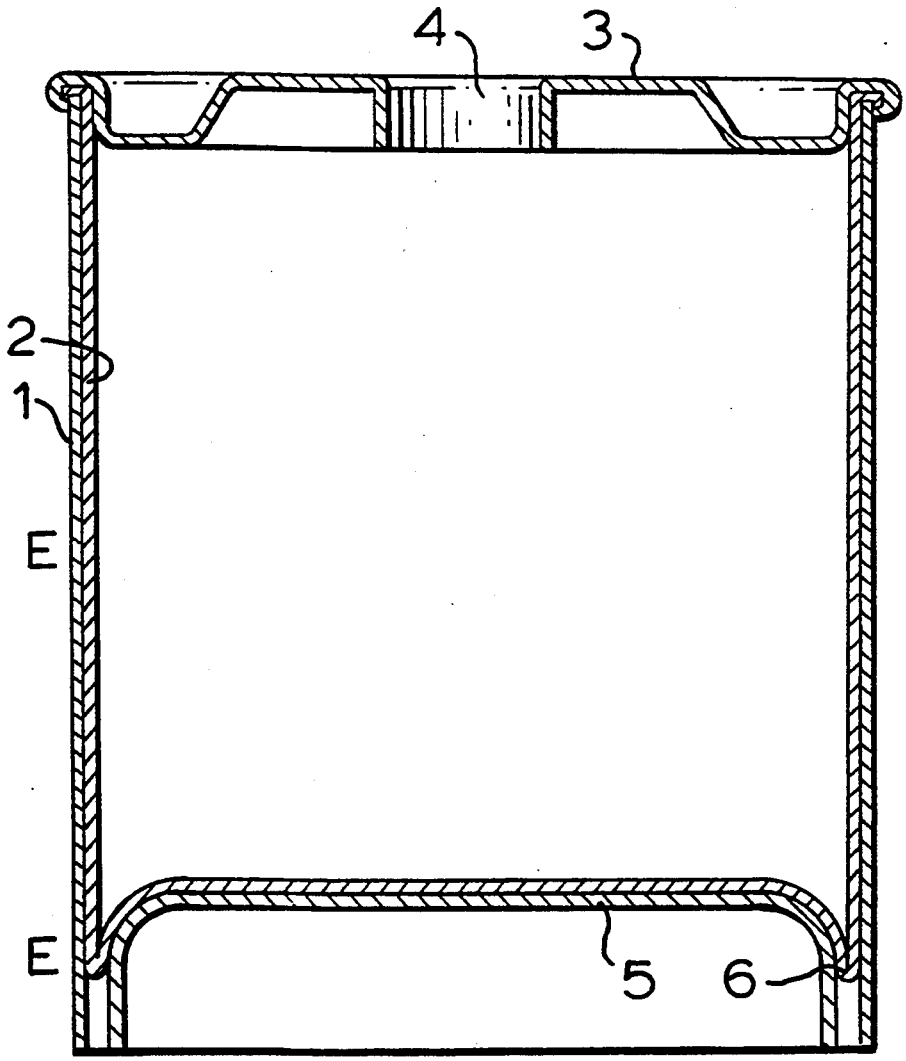
FIG. 1 shows a container for fluid to be sprayed.

In the container of FIG. 1 an outer casing 1 confines and controls a flexible wall 2 of the container proper, made of for example polymer with enhanced barrier properties, inherently, as with fluorinated polymers, or for example by lamination with a metallised polymer film. At one end of the container is a crimped-on metal closure cap 3 retaining a cardboard outer casing 1 and sealing the flexible wall 2 in place; it has a receiving neck 4 for a delivery valve, not shown in the present figure. At the other end of the container is a plate 5 through which pressure is applied in use of the gun to expel fluid from the container. The flexible wall 2 is continuous with a layer of material covering and bonded to plate 5. In use the flexible wall, which if bonded to the outer casing 1 at all is free over the distance E—E marked on the drawings, everts in the manner of a diaphragm seal as the pressure plate 5 is pushed in, until all usable fluid has been expelled. A trapped doubled portion as at 6 remains throughout.

Figure 3:
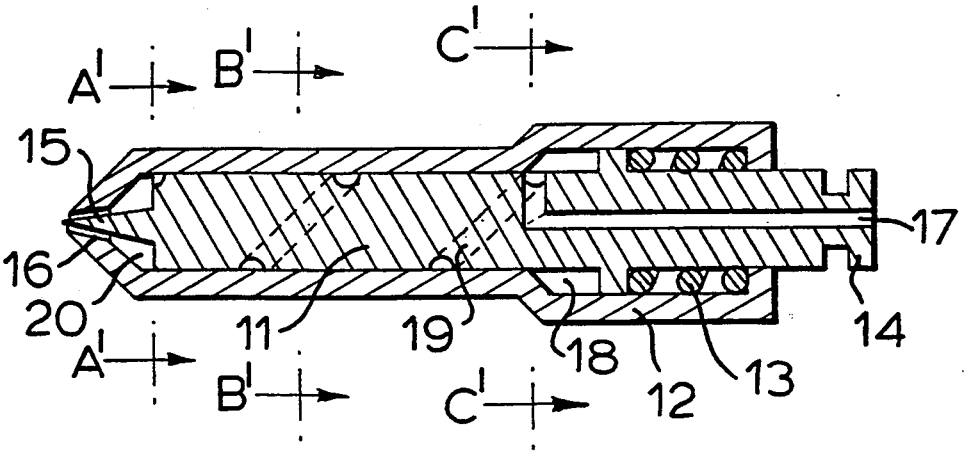
FIG. 3 shows a delivery valve with a helical fluid path, FIGS. 3*a* to 3*c* showing the valve in cross sectional view at A′—A′, B′—B′ and C′—C′ respectively in FIG. 3.
Figure 3A:
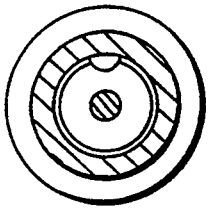
Figure 3B:
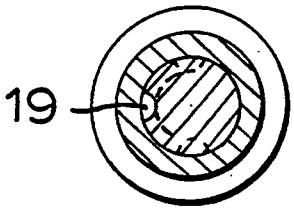
Figure 3C:
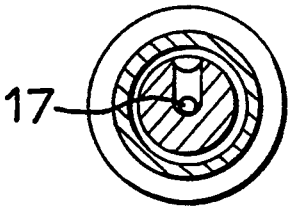

In FIGS. 2 and 3 the delivery valve shown has a fixed part or value member 11 and a moving part 12, urged to the closed position by a spring 13 and held in chosen open positions by an interengaging pin and multiple-position bayonet slot (not shown; the pin projects from part 12*a* of valve member 12 and the slot is formed in part 11*a* of valve member 11.) A neck 14 is provided to enter the receiving neck 4 of the closure cap 3 and be sealed into it. At the discharge end of the delivery valve a needle 15 engages a seat 16 of the moving valve-part 12 in the closed position, or when the moving part 12 is moved forward against the pressure of spring 13 allows fluid to pass (as drawn, 15 and 16 are slightly separated for clarity).

In both valves the fluid path is via an entry channel 17 to a distributing chamber 18 and thence by a flow control channel 19 to a discharge chamber 20. In the valve of FIG. 2, alternative part-channels 21, 22, 23 of increasing size are formed in the fixed valve part 11 as seen in FIG. 2*b*; they cooperate with a part-channel 24 in the moving valve-part 12, giving a choice of flow rates. In the valve of FIG. 3 there is not this provision, though the effective length of channel 19 shortens as the moving valve-part is advanced and the opening afforded by needle 15 and seat 16 increases in size.

Figure 4:
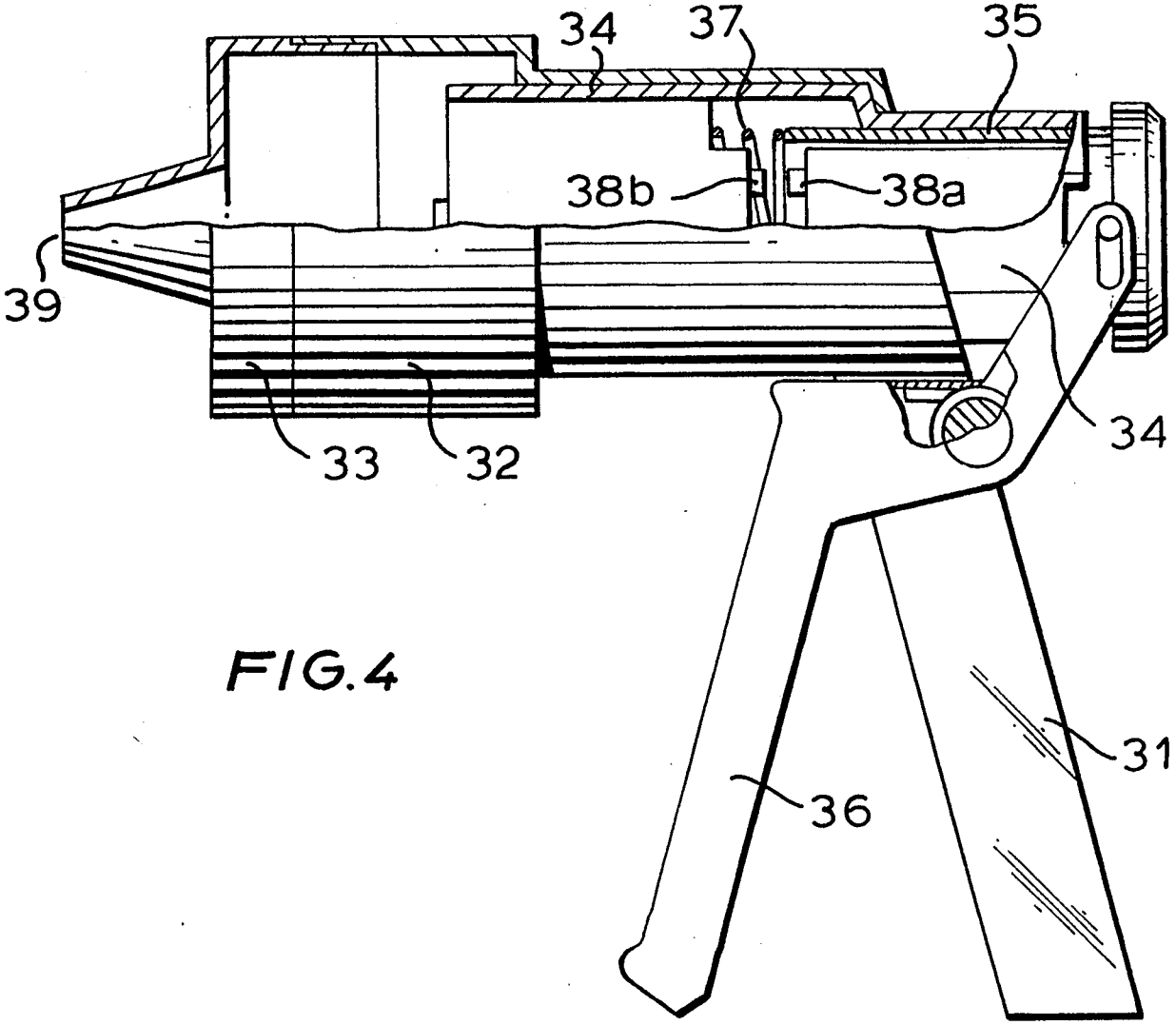
FIGS. 4–6 show alternative guns in which containers as in FIG. 1 and the delivery valves of FIGS. 2 and 3 may be used.
Figure 5:
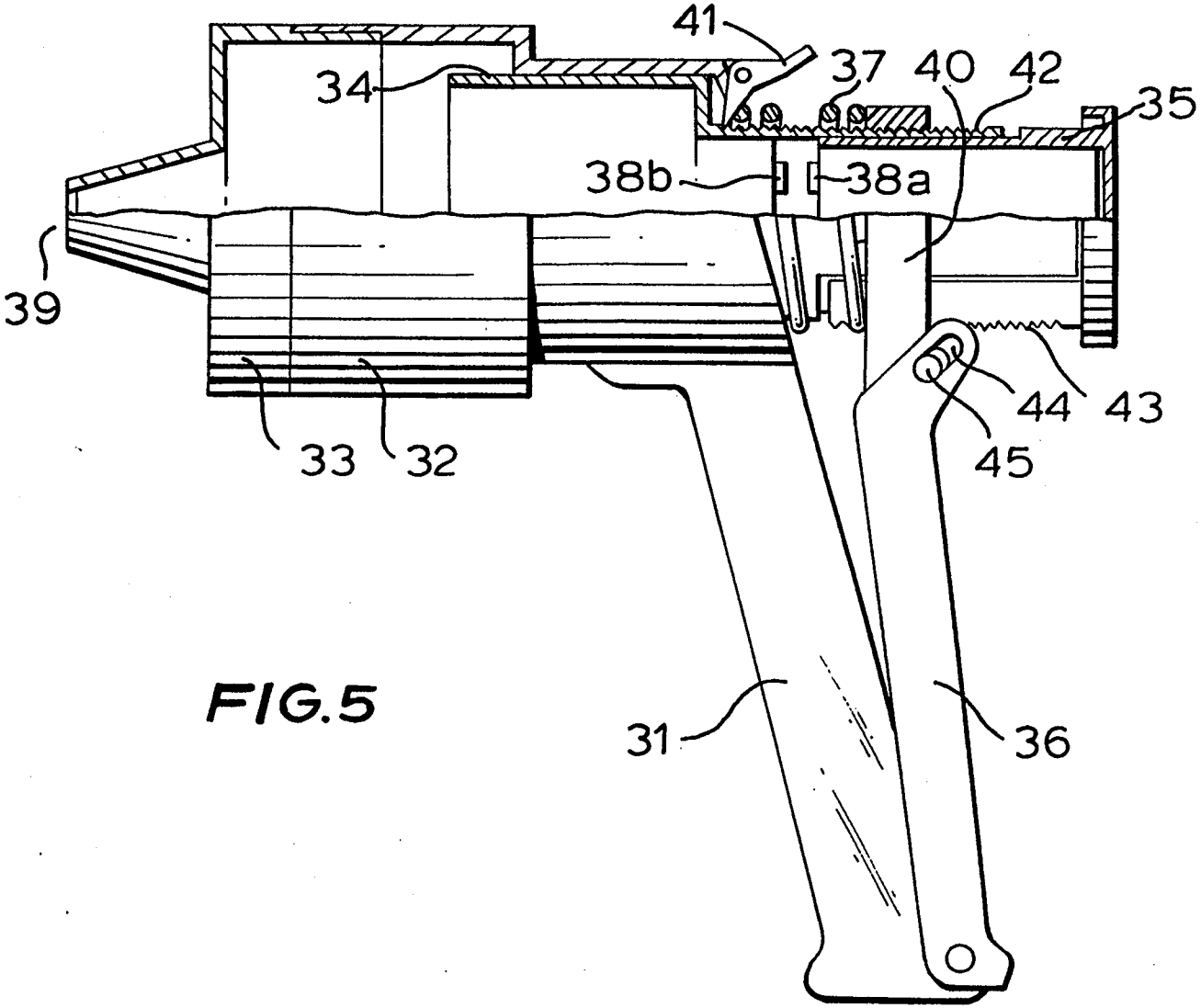
Figure 6:
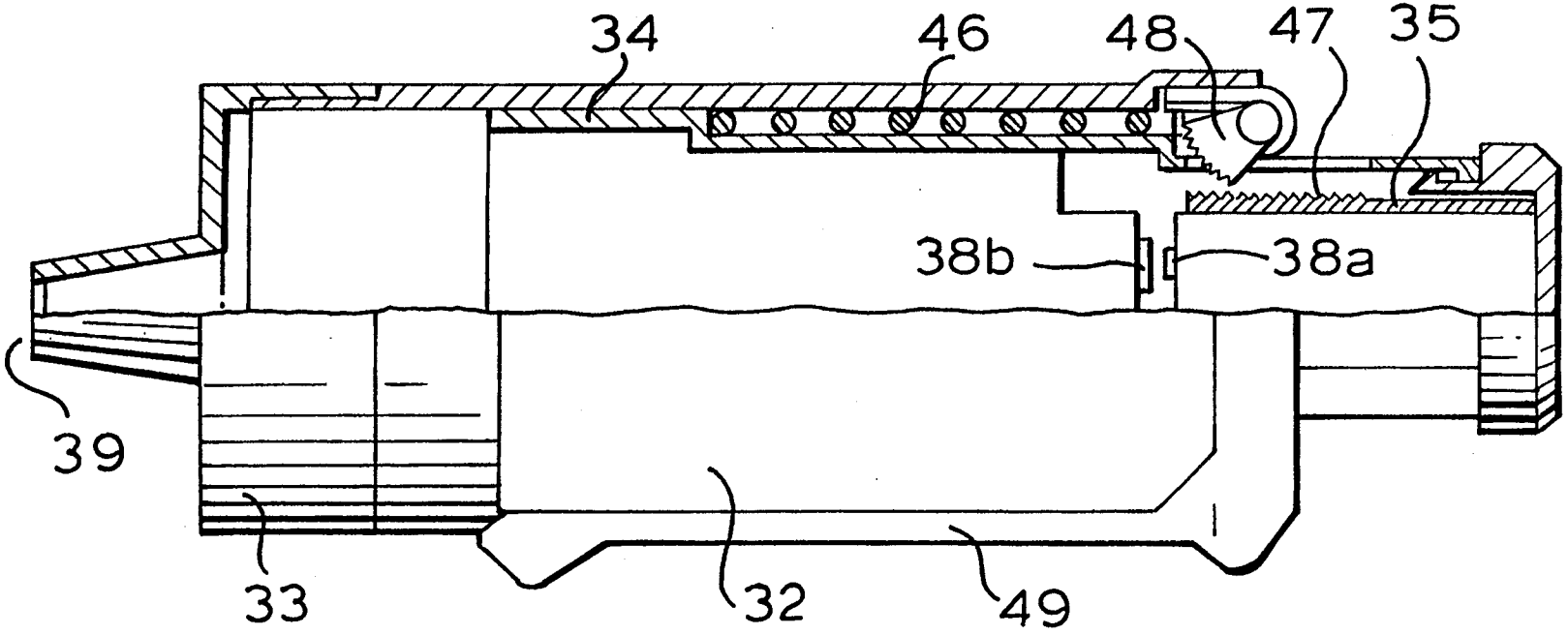

The guns of FIGS. 4–6 are all broadly similar, each having a body that houses the container and valve and consists of relatively slidable parts. When the parts are moved relative to each other by a handgrip mechanism or otherwise an electrostatic generator housed in one part makes contact, and at the same time the collapsible container has compressive force applied to it and fluid, such as paint, is expelled through the valve and formed into an electrostatic spray.

In the particular design of FIG. 4 a main handle 31 and fixed body 32 are formed of a plastics moulding, and a removable cap 33, a plastics moulding again, is provided. Within the body 32 are slidable housings 34 and 35 (within 34) that contain batteries and a generator of known kind and no part of the invention in themselves. They provide for example 17 kV for flow rates up to 10 ml/min or 28 kV for flow rates up to 20 ml/min. A squeeze grip 36 when moved, initially brings the housing 35 inwards against the pressure of a spring 37 until contacts 38*a*, 38*b* meet and then advances housing 34 together with housing 35, compressing a container (not shown) held in the forward end of the body with its valve, and delivering fluid which exits as a spray through delivery opening 39.

To load the gun a container such as in FIG. 1 and nose piece or cap 33 suited to the size of container are taken, the valve being opened to the required position before the container is fitted in the cap. The container and cap are then fitted to the gun, electrical contact being made through electrically conductive tracts (not shown) providing a path to an electrode at the delivery opening or outlet 39 and a path to a contact within the cap for the metal closure cap 3, electrical connection being made on insertion of the container. From the closure cap 3 the electrical path is through the inner valve member 11 to the needle or tip 15, the outer valve member 12 being insulating and the inner one 11 conducting.

Alternatively, electrical connections independent of the valve may be provided, the valve serving simply to deliver fluid and the electrical forces being generated at spaced electrodes on the cap. A suitable design is afforded for example by U.K. patent specification 2 030 060 referred to earlier herein, the integral container and nozzle there shown being replaced by a container and valve as described herein and the electrodes being provided at outlet 39.

The gun is used until sufficient fluid has been supplied when on release of the squeeze grip, spring 37 in the gun body releases the pressure on the container to stop fluid delivery and separates the contacts 38*a* and 38*b* so that the electrostatic field ceases to be generated. The gun may be used until the container is empty or if required the container may be removed and resealed, the action of spring 13 ensuring that fluid is not lost once the valve is released from the open position. In any event when a container is empty cap 33 is removed and a fresh container inserted. Variable capacity is conveniently provided by use of alternative caps, and the cap and container can be a unit if desired.

The gun of FIG. 5 is similar and corresponding parts are numbered as in FIG. 4. As before, operation of the squeeze grip 36 first draws in the electrostatic generator housing 35 to make contact at 38*a*, 38*b* and then advances the housing 34 to deliver fluid. The position of the housing 34 is controlled by rack 42 and pawl 41, return of the housing being allowed when the outer end of pawl 41 is depressed. Advance of the housing is effected by another rack 43 and pawl 45, actuated by squeeze grip 36 movement of which is provided for by slot 44. The double arrangement of ratchets and pawls allows a greater force to be applied to the container than would be possible if the squeeze grip had to effect the full travel. The compression is first effected over the travel given by one movement of the squeeze grip then the grip is released and the spring 37 returns member 40. The position of the container is maintained by pawl 41 as member 40 first rides back over the rack then re-engages for re-establishment of contact of 38*a*, 38*b* and further travel.

The gun of FIG. 6 is broadly similar as to its body 32, cap 33, fluid-container housing 34, outlet 39, electrostatic generator housing 35 and contacts 38*a*, 38*b*. The container housing 34 is urged forward by a compression spring 46 that provides the necessary force to collapse the container. The system is "primed" by insertion of a container while a torsion spring and ratchet system 47, 48 provides control over the compressive force through a pivoting hand grip 49.

Figure 7:
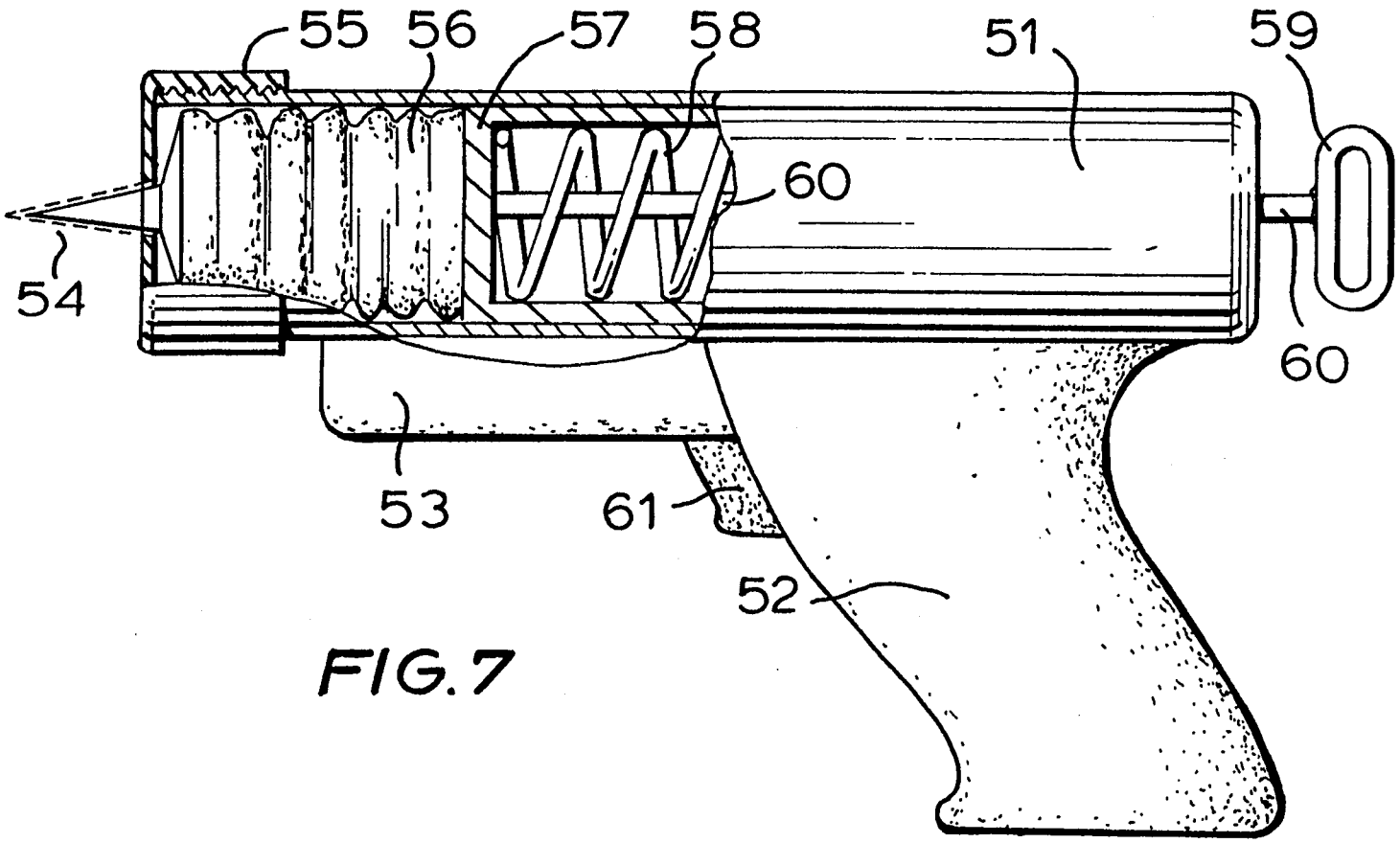
FIG. 7 shows a further alternative gun.

Referring to FIG. 7, there is seen a further gun with a different construction. A body 51 carries a handle 52 in which batteries are held for powering a generator in housing 53 effecting electrostatic spraying from a schematically indicated delivery nose 54 formed on a detachable end cap 55 on the housing and having the required electrical connections. (Alternatively the nose may be an integral part of the container protruding through an orifice in the end cap). Within the housing is a concertina container 56 loaded via a piston 57 by a spring 58. A handle 59 drawing a rod 60 compresses the spring manually on loading of a full container. To use the gun a trigger 61 is depressed, operating a generator contact switch and at the same time releasing a variable brake on the rod 60 by which the pressure exerted on the container is controlled (delivery is stopped by releasing the trigger and, preferably, pulling back the handle 59 slightly). Variable sizes of containers are accommodatable by spacers between the piston and the container itself or can simply be accommodated by changing the travel, e.g. for sachets pull back 2.5 cm whereas for concertinas pull back 7.5 cm. The piston end can be moulded to conform to the container configuration.

Figure 8:
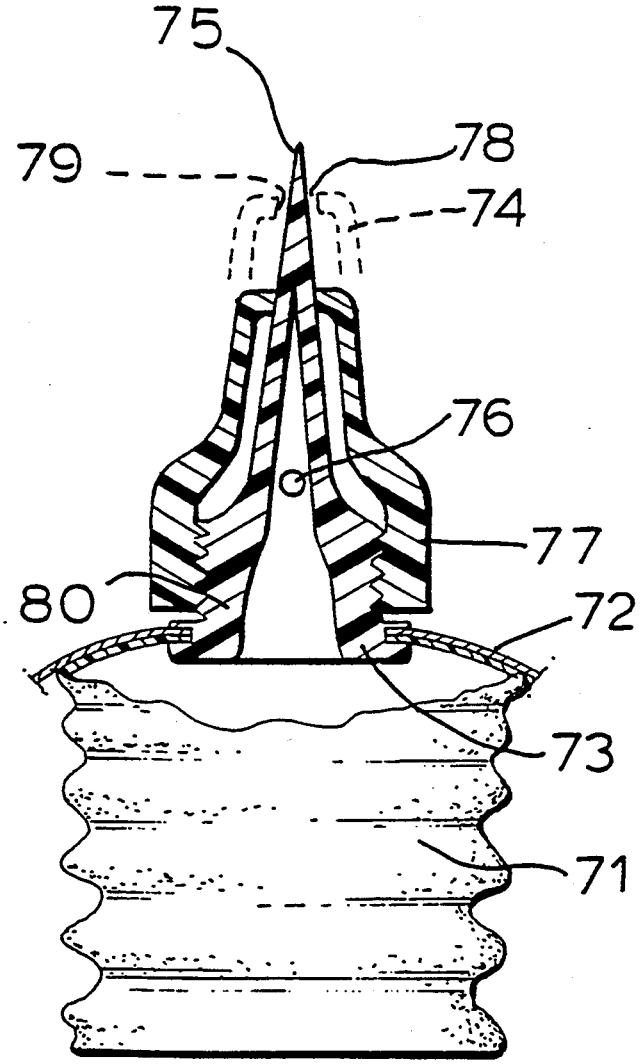
FIG. 8 shows a valve and container.

In FIG. 8 the container is shown, with the valve, in further though still part-schematic detail. It comprises a flexible body 71 and an aerosol-can style metal dome 72. The body is sealed to the dome by flange 73 of a valve inner member 80 to which electrical contact is made on insertion of the container, corresponding to that made with end cap 3 in the container of FIG. 1 as described above; alternatively, as before, separate electrically conducting tracts may be provided to the delivery nose 54.

The valve is shown in the closed position with the open position indicated at 74. The valve-inner has a blind tip 75 and an orifice 76 through which paint or other fluid emerges from the container. Flow is controlled by a sleeve or valve-outer 77, which (as shown) closes or (in the dotted position) opens an annular path 78 through which the fluid emerges to pass to form the electrostatic spray. A self sealing and self cleaning design is therefore given, paint etc. not being able to dry up in the closed space between the valve inner and the sleeve, and being wiped from the sealing area 79 by the closing action. As shown the sleeve is screwed; alternatively and preferably it snaps between open and closed positions by provision instead of the screw thread of an annular raised ridge on the sleeve and two corresponding grooves on the valve inner, or vice versa, to provide limit positions so that the valve is positively open or positively closed.

We claim:

1. An electrostatic spray gun comprising:

a housing;

a handle adjacent said housing;

a replaceable, collapsible container receivable in said housing;

a nozzle in communication with said container for spraying fluid from said container;

a delivery valve having inner and outer valve members, said valve members being movable relative to one another to form an opening for supplying fluid from the container or to form a seal for preventing escape of fluid from the container;

a squeeze gripping means mounted on said housing for transmitting a compressive force to the container to deliver fluid to said nozzle; and a high voltage generator for applying electrostatic potential to the fluid such that the fluid emerges from said nozzle in a form of an electrically charged atomized spray.

2. An electrostatic spray gun according to claim 1 wherein said delivery valve further comprises at least one elongated channel having a flow-limiting cross section by which a flow rate of fluid from said container through said nozzle is controlled.

3. An electrostatic spray gun according to claim 2 wherein said elongated channel has an adjustable length for changing flow rate of said fluid out of said nozzle.

4. An electrostatic spray gun according to claim 2 comprising at least two elongated channels having differing cross sections.

5. An electrostatic spray gun according to claim 2 wherein said container comprises a flexible wall having bellows, said container being collapsible by said compressive force applied to a rear portion of the container, said delivery valve being positioned near a front portion of the container when said container is received in said housing.

6. An electrostatic spray gun according to claim 2 wherein said container comprises a flexible wall contained within a rigid sleeve, said fluid being delivered to said nozzle by eversion of said flexible wall.

7. An electrostatic spray gun according to claim 2 wherein a portion of said inner valve member is positioned inside said outer valve member, said inner valve member including a blind tip extending outside of said outer valve member and an aperture in a side of said inner valve member through which fluid in the container enters the delivery valve and emerges around said inner valve member in a space between said inner valve member and said outer valve member, a flow rate of fluid through said nozzle being controlled by relative movement of said inner and outer valve members.

* * * * *